US005690261A

United States Patent [19]

Moore

[11] Patent Number: 5,690,261

[45] Date of Patent: Nov. 25, 1997

[54] SKATE CARRIER

[76] Inventor: Jay Gary Moore, 720 W. Shubert Ave., Chicago, Ill. 60614

[21] Appl. No.: 744,062

[22] Filed: Nov. 5, 1996

Related U.S. Application Data

[63] Continuation of Ser. No. 324,091, Oct. 14, 1994, abandoned.

[51] Int. Cl.[6] ..... A45F 5/00

[52] U.S. Cl. ..... 224/578; 224/605; 224/660; 224/674; 224/676; 224/677; 224/250; 224/258; 224/901.4; 206/278

[58] Field of Search ..... 224/578, 605, 224/660, 674, 677, 676, 901.4, 250, 257, 258, 901; 294/162, 163, 159; 206/278; 36/136, 1; 2/920, 338, 321, 322

[56] References Cited

U.S. PATENT DOCUMENTS

| | | | |
|---|---|---|---|
| 2,428,074 | 9/1947 | Hanson . | |
| 3,653,565 | 4/1972 | McAusland . | |
| 4,264,024 | 4/1981 | Harris, Jr. . | |
| 4,331,357 | 5/1982 | Contreras . | |
| 4,337,883 | 7/1982 | Pate . | |
| 4,420,104 | 12/1983 | DiIenno | 224/253 |
| 4,483,470 | 11/1984 | Cousins | 224/257 |
| 4,863,083 | 9/1989 | Chen . | |
| 4,896,806 | 1/1990 | Sanchez, Jr. . | |
| 4,966,321 | 10/1990 | Outlaw | 224/253 |
| 5,129,560 | 7/1992 | Herman | 224/151 |
| 5,147,261 | 9/1992 | Smith et al. | 2/338 |
| 5,388,274 | 2/1995 | Glover et al. | 2/338 |
| 5,497,923 | 3/1996 | Pearson et al. | 224/904 |
| 5,629,580 | 12/1993 | Hsiao . | |

FOREIGN PATENT DOCUMENTS

| | | | |
|---|---|---|---|
| 2310112 | 12/1976 | France | 36/1 |

OTHER PUBLICATIONS

Look Ma No Hands! Advertisement For Cordless Phone Holster.

*Primary Examiner*—Linda J. Sholl
*Attorney, Agent, or Firm*—James C. Paschall

[57] ABSTRACT

A device and method for carrying skates of different sizes comprising an elongate strap with a coupling means for securement of said first end to said second end, a receptacle including a bearing member for supporting any skate chosen from a range of different sizes in said receptacle, a first wall and a second wall for cooperatively maintaining said skate on said bearing member, and means for adjustably coupling said first wall to said second wall to secure said skate in said receptacle, and a retainer on said receptacle for suspending said receptacle on said strap.

19 Claims, 5 Drawing Sheets

SKATE CARRIER

This is a continuation of application Ser. No. 08/324,091, filed on Oct. 14, 1994 now abandoned.

FIELD OF THE INVENTION

This invention relates to a device for carrying skates and more particularly roller skates on the waist or over the shoulder of a person. The invention can also be used to carry shoes around the waist or over the shoulder of a person.

DISCUSSION OF PRIOR

The roller skating industry has experienced a resurgence recently with the introduction of in-line skates. The resurgence is attributed to the swifter design of in-line roller skates visa vis conventional roller skates.

The conventional roller skates usually have two wheels paired near the front of the skate and two wheels paired near the back of the skate, so the skater has a rectangular base for self-balancing. Whereas, the in-line roller skate has all of the wheels aligned in a linear set down the longitudinal center of the skate, so the skater must maintain his own balance like an ice skater instead of relying on a rectangular base of balance for support. As a result, in-line skates enable the skater to make quicker maneuvers and skate faster because the linear formation of the wheel set is less cumbersome. The in-line roller skates allow the skater to maneuver much more like an ice-skater than a conventional roller-skater.

Due to the swifter design, the number of in-line skaters has increased by nearly 500% between 1989 and 1994, so that currently there are over fifteen million skaters. In-line roller skating is becoming the fastest growing sport in America. Accordingly, the need for accessories which enhance the enjoyment of skating becomes more and more in demand.

The in-line skate is often used as transportation to destinations instead of for merely circuitous trips, where the trip is concluded at the same point where it was begun. Often when used for transportational purposes the skater must carry his street shoes so he can change into the street shoes upon arrival at the destination. This presents two problems: (1) carrying the street shoes while skating, and (2) carrying the skates while walking in the street shoes.

Frequently, skaters just tie the shoe strings of the street shoes together and sling the shoes over the shoulder. Likewise, once the street shoes are put on the skates are coupled together in some fashion and also slung over the shoulder. This method of porting the skates or the shoes is attended by several disadvantages. One disadvantage results because the skates often pick up a lot of the dirt and grime when they are used to skate on a typical roadway. Once the skate is slung over the shoulder, the skate gets this dirt and grime on the clothes or body of the skater. This is also a similar problem when the shoes are slung over the shoulder.

Additionally, skaters frequently work and move their arms when they skate to keep their balance, to exercise and to streamline their skating technique. Therefore, it is important to keep a skater's arms and shoulders free of obstruction. Moreover, skaters often skate down paved streets or walks at fairly high speeds. If the skater were to fall, injury is likely. Slinging the shoes over the shoulder obstructs arm and shoulder motion and generates an imbalance in the skater, thereby increasing the likelihood that the skater would fall in certain situations.

Furthermore, roller skaters are frequently seeking exposure to sun to obtain a tan. Slinging the skates over the shoulder often causes the skater to tan unevenly, an undesirable effect for one who seeks a suntan.

No devices have been introduced which overcome all of these disadvantages. Handbags for storing the skates have been introduced. These bags have a pair of loops inside the bag which loop around the wheels and hold the skates stationery. However, these bags must be either carried by hand or by a shoulder strap and therefore suffer some of the same disadvantages which attend slinging the skates over the back.

Backpacks have also been introduced for porting the roller skates. Although these devices need not be carried by hand, because the backpack is cumbersome it restricts arm movement and will not allow one to tan evenly on their back. Additionally by carrying a backpack a skater raises the center of gravity in their body, thereby improving the chances for a fall.

A waist pack has also been introduced for carrying skater's shoes while skating. However, the waist pack does not have the capacity to carry skates. Instead, a separate device must be utilized for carrying skates over the shoulder while not skating. Skates, and particularly in-line skates, are quite large. Even if a waist pack was fashioned large enough to carry two skates, it would be very bulky to wear on the waist.

Accordingly, an object of this invention is to provide a device for carrying skates without having to sling them over the shoulder. Another object of this invention is to provide a device for carrying skates which do not significantly alter the center of gravity of the skater. Another object of this invention is to provide a device for carrying skates that frees the hands for balance and safety purposes. An additional object of this invention is to provide a device for carrying skates which is lightweight and not cumbersome. A further object of this invention is to provide a device for carrying skates which can be adjustable to carry skates of different sizes. An even further object of this invention is to provide a device for carrying skates which can also be adjusted to carrying street shoes of the skater. A still further object of this invention is to provide a device for carrying skates which is ported on the waist.

SUMMARY OF THE INVENTION

The present invention uses two receptacles retained on an elongated strap which can be fastened to provide a complete loop. Once the strap is fastened into a loop the strap can be worn around the waist, or, if desired, worn over the shoulder. The two receptacles are suspended from the strap. Each receptacle receives one skate. Each receptacle consists of two walls which are coupled together by a bearing member attached to each wall at its end.

The present invention in its various aspects has only been summarized briefly. For a better understanding of the present invention and its objects and advantages, reference should be made to the following description of its preferred embodiment taken in conjunction with the accompanying drawings.

BRIEF DESCRIPTION OF THE DRAWINGS

A preferred embodiment of the present invention is described with reference to the accompanying drawings.

DETAILED DESCRIPTION

Figure 1:
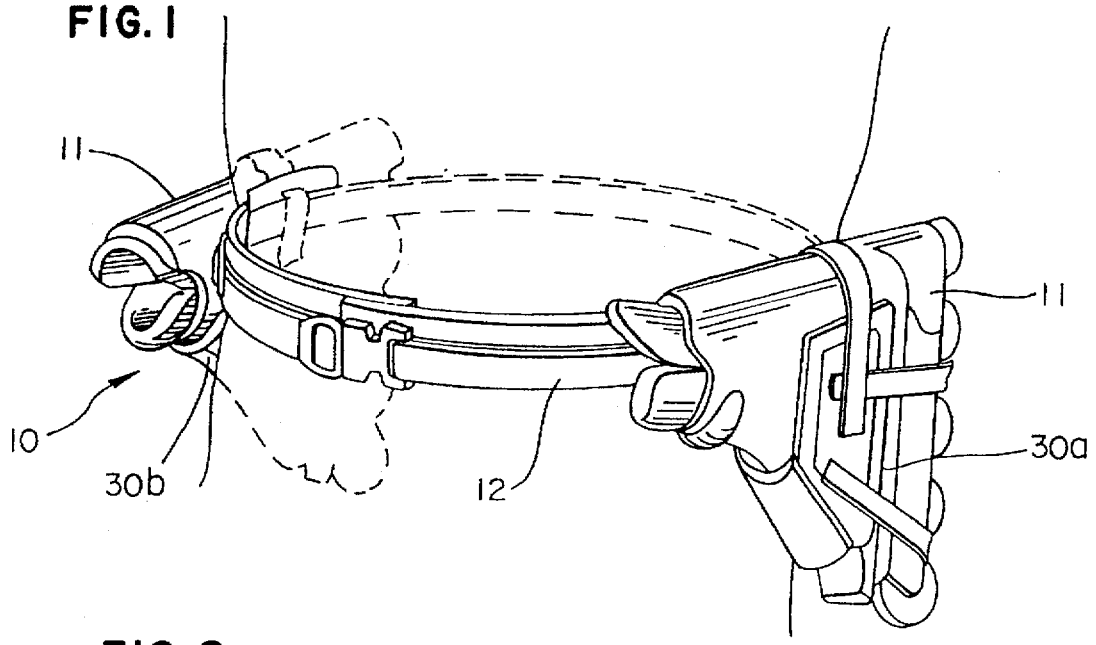
FIG. 1 is a perspective view of a skate carrier of the present invention fastened around the waist of a user.
Figure 2:
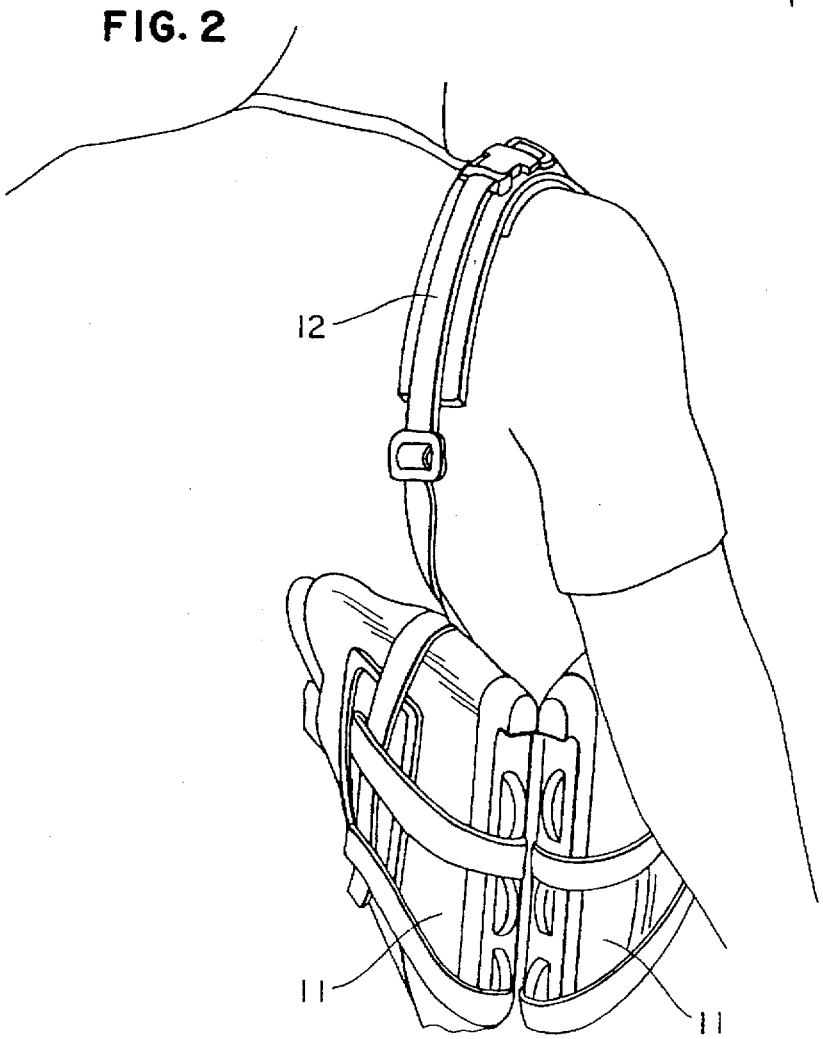
FIG. 2 is a perspective view of the skate carrier slung over the shoulder of a user.
Figure 3:
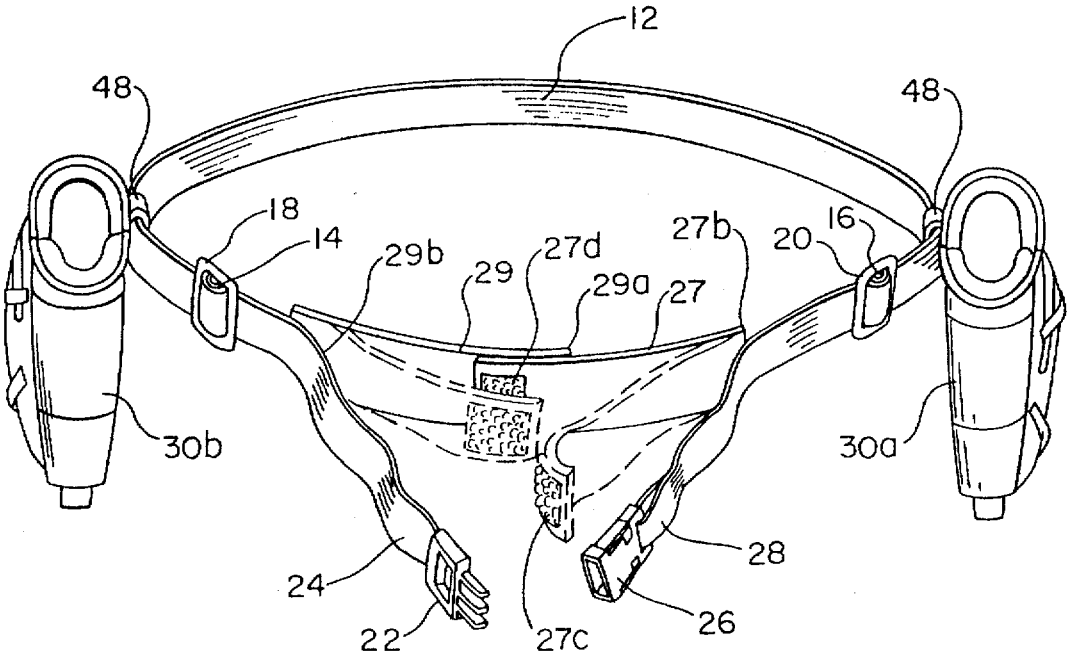
FIG. 3 is a frontal perspective view of the skate carrier with a fastening mechanism opened.

A device 10 for carrying skates 11 of different sizes is shown in FIG. 1. The device 10 can be worn around the waist of a user, as shown in FIG. 1, or worn around over the shoulder of the user as shown in FIG. 2. As best shown in FIG. 3, an elongate strap 12 made of canvas, nylon or other suitable material has a first end 14, a first buckle 18, and a second end 16 stitched to a pin of a second buckle 20. The first end 14 is looped around a pin of a male latch member 22, doubled back and threaded through and around the pin of the first buckle 18. The portion of the strap looped around the pin of the male latch member 22 is a first effective end 24. Likewise, the second end 16 is looped around a pin of a female latch member 26, doubled back and threaded through and around the pin of the second buckle 20. The portion of the strap 12 looped around the pin of the female latch member 26 is a second effective end 28.

Upon adjusting the length of the strap 12 between the first buckle 18 and the male latch member 22, and/or the length of the strap 12 between the second buckle 20 and the female latch member 26, a user increases or decreases the effective length of the strap 12 between the first effective end 24 and the second effective end 28. A protruding portion of the male latch member 22 is inserted into a receiving portion of the female latch member 26 to secure the first effective end 24 of the strap to the second effective end 28 of the strap 12. Upon securing the effective ends 24, 28 of the strap 12 into a loop of suitable circumference, the strap 12 can be easily carried by wearing it around the waist as shown in FIG. 1 or over the shoulder as shown in FIG. 2, or in a variety of other ways.

Figure 4:
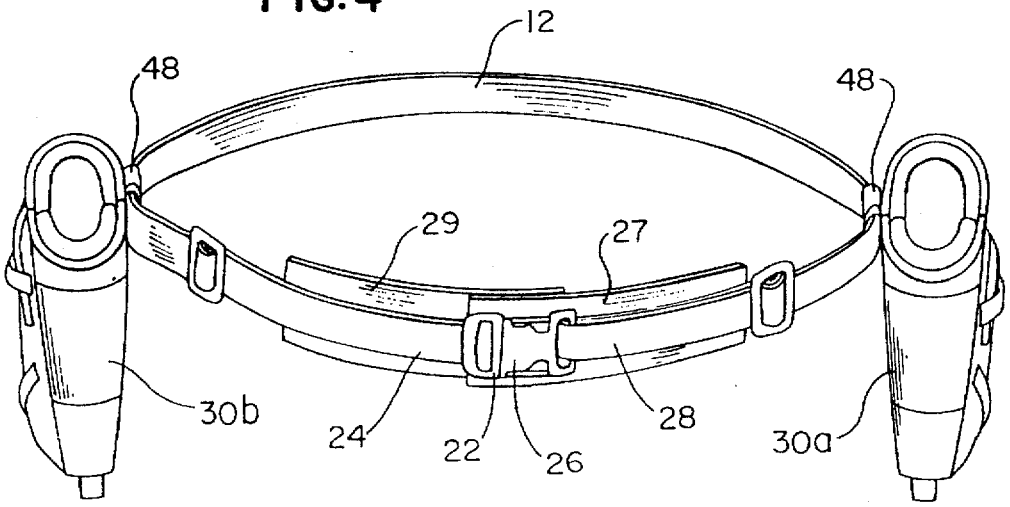
FIG. 4 is a frontal perspective view of the skate carrier with the fastening mechanism closed.

As shown in FIGS. 3 and 4, the strap 12 further includes a first supplemental strap 27 having a proximal end 27*a* and a distal end 27*b* with the distal end 27*b* connected to the strap 12 and a second supplemental strap 29 having a proximal end 29*a* and a distal end 29*b* with the distal end 29*b* connected to the strap 12. A strip of VELCRO® loops 27*c* is stitched to the proximal end 27*a* of the first supplemental strap 27 and a strip of VELCRO® hooks 29*c* is stitched to the proximal end 29*a* of said second supplemental strap 29. The proximal end 27*a* of the first supplemental strap 27 is secured to the proximal end 29*a* of the second supplemental strap 29 by engaging the strip of VELCRO® loops 27*c* to the strip of VELCRO® hooks 29*c*.

The supplemental straps 27, 29 supplement the securement provided by the engagement of the male latching member 22 and the female latching member 26. Moreover, when securing the carrier 10 around the waist, the supplemental straps 27, 29 are easier to secure together than engaging the male fastening member 22 to the female latching member 26. Hence, the supplemental straps 27, 29 can be secured together first to facilitate adjustment of the length between the first effective end 24 and the second effective end 28 to obtain the desired fit before engaging the male fastening member 22 and the female fastening member 26 to completely secure the skate carrier 10 around the waist at the desired circumference.

A strip of VELCRO® hooks 27*d* is stitched to the proximal end 27*a* of the supplemental strap 27. A strip of VELCRO® loops (not shown) are adhered to a back of the female fastening member 26. The strip of VELCRO® hooks 27*d* can be engaged to the VELCRO® loops on the back of the female fastening member 26.

Two receptacles 30*a* and 30*b* made of canvas, NYLON or other suitable material are suspended from the strap. Because the receptacles 30*a*, 30*b* have the same structure and function, only one will be described in detail with reference to FIGS. 5–8. As shown best in FIGS. 6 and 7, the receptacle 30*a* has a first wall 32 and a second wall 34 interconnected by a bearing member 38 and a positioning member 40. The first wall 32 and the second wall 34 are shaped like a trapezoid with three of the four sides intersecting at right angles.

The first wall is defined by four edges: a first top edge 42*a*, which is adjacent to a first front edge 42*b*, which is adjacent to a first bottom edge 42*c*, which is adjacent to a first rear edge 42*d*, which is adjacent to the first top edge 42*a*. The first front edge 42*b* and the first rear edge 42*d* are opposed in parallel arrangement, wherein the first front edge 42*b* is longer than the first rear edge 42*d*. Hence, the first top edge 42*a* and the first bottom edge 42*c* are opposed but are not parallel to each other. Strips of VELCRO® loops 43 are stitched to cover an exterior side of said first wall 32.

Figure 6:
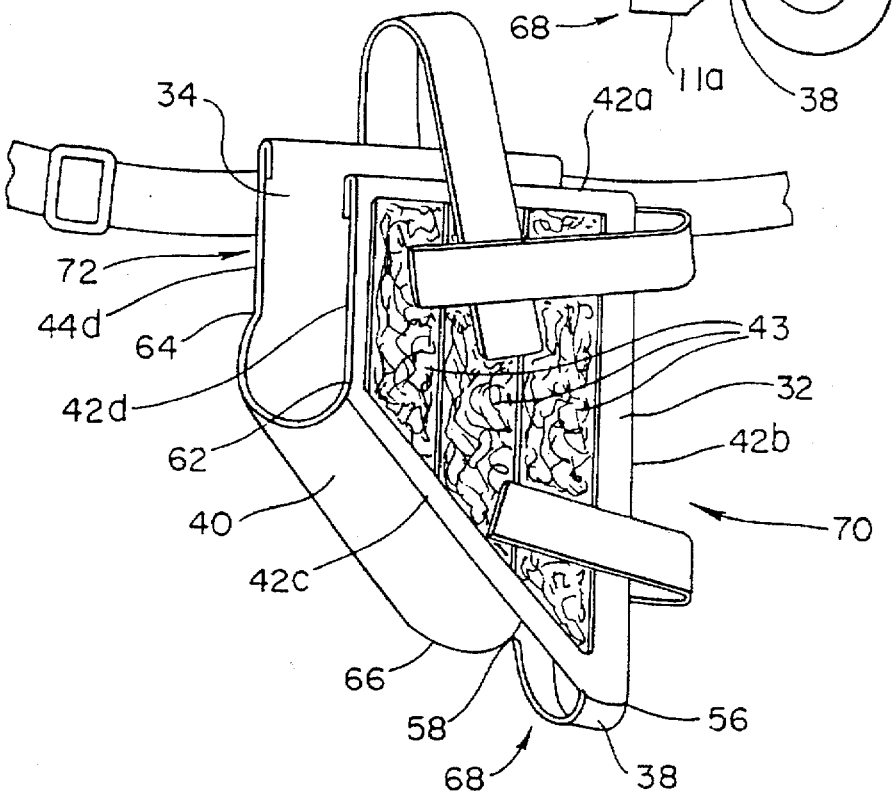
FIG. 6 is a perspective view of the skate receptacle of FIG. 5 without a skate.
Figure 7:
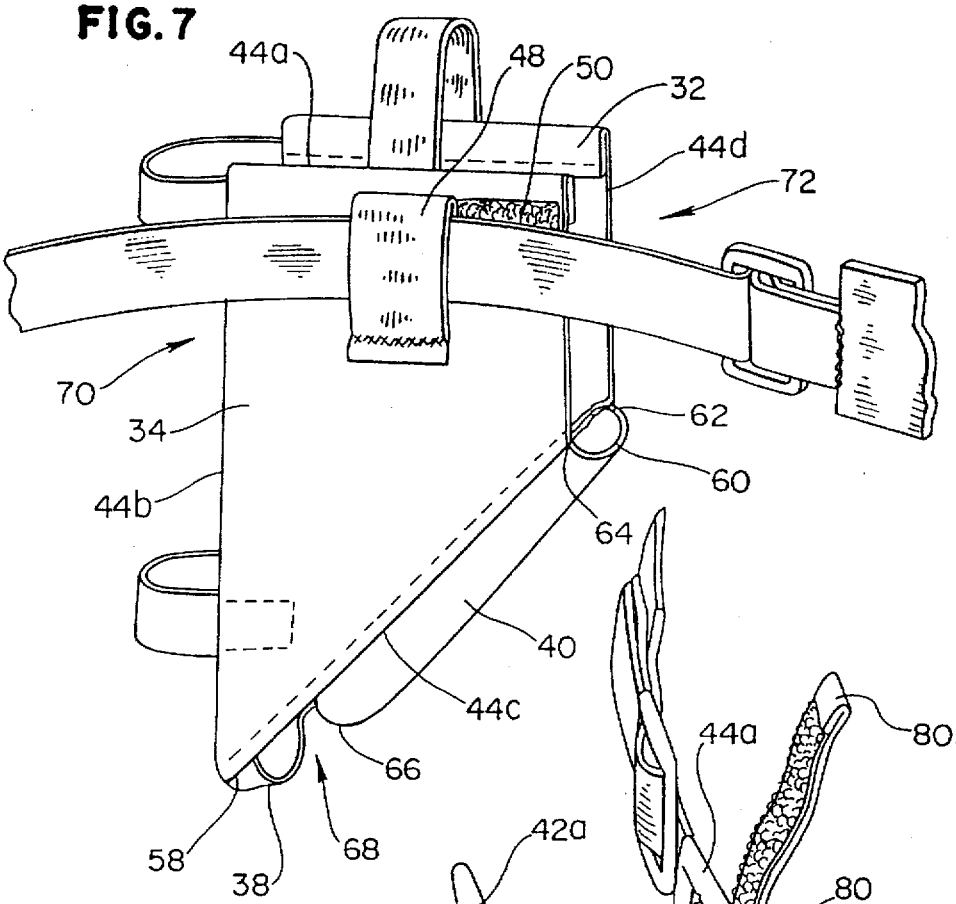
FIG. 7 is a perspective view of the opposite side of the skate receptacle of FIG. 6.

As best shown in FIG. 6, the second wall 34 is disposed opposite and has a similar profile as the first wall 32. The second 34 wall is defined by four edges: a second top edge 44*a*, which is adjacent to a second front edge 44*b*, which is adjacent to a second bottom edge 44*c*, which is adjacent to a second rear edge 44*d*, which is adjacent to the second top edge 44*a*.

A vertical belt loop 48 is stitched to an exterior side of said second wall 34. Additionally, a strip of VELCRO® loops 50 are stitched to the exterior side of the second wall 34 between the belt loop 48 and the first rear edge 44*d*.

The first wall 32 and the second wall 34 are interconnected by a bearing member 38 and a positioning member 40. The bearing member 38 is a thong with one end connected to a first bottom corner 56 where said first front edge 42*b* and said first bottom edge 42*c* intersect. The other end of the thong is connected to a second bottom corner 58 where said second front edge 44*b* and said second bottom edge 44*c* intersect.

The positioning member 40 is stitched contiguously with the first bottom edge 42*c* on one side and the second bottom edge 44*c* on the other side. The positioning member has a top edge 60 extending between a first top corner 62 where the first rear edge 42*d* and the first bottom edge 42*c* intersect and a second top corner 64 where the second rear edge 44*d* and the second bottom edge 44*c* intersect. The positioning member 40 also has lower edge 66 which is disposed shortly above said first bottom corner 56 and said second bottom corner 58. Therefore, a toe opening 68 is defined by the bearing member 38, the first bottom edge 42*c*, the lower edge 66 of the positioning member and the second bottom edge 44*c*.

A wheel set opening 70 is adjacent to the toe opening 68 in the receptacle 30*a*. The wheel set opening 70 is defined by the first front edge 42*b*, the bearing member 38 and the second rear edge 44*b*.

Figure 5:
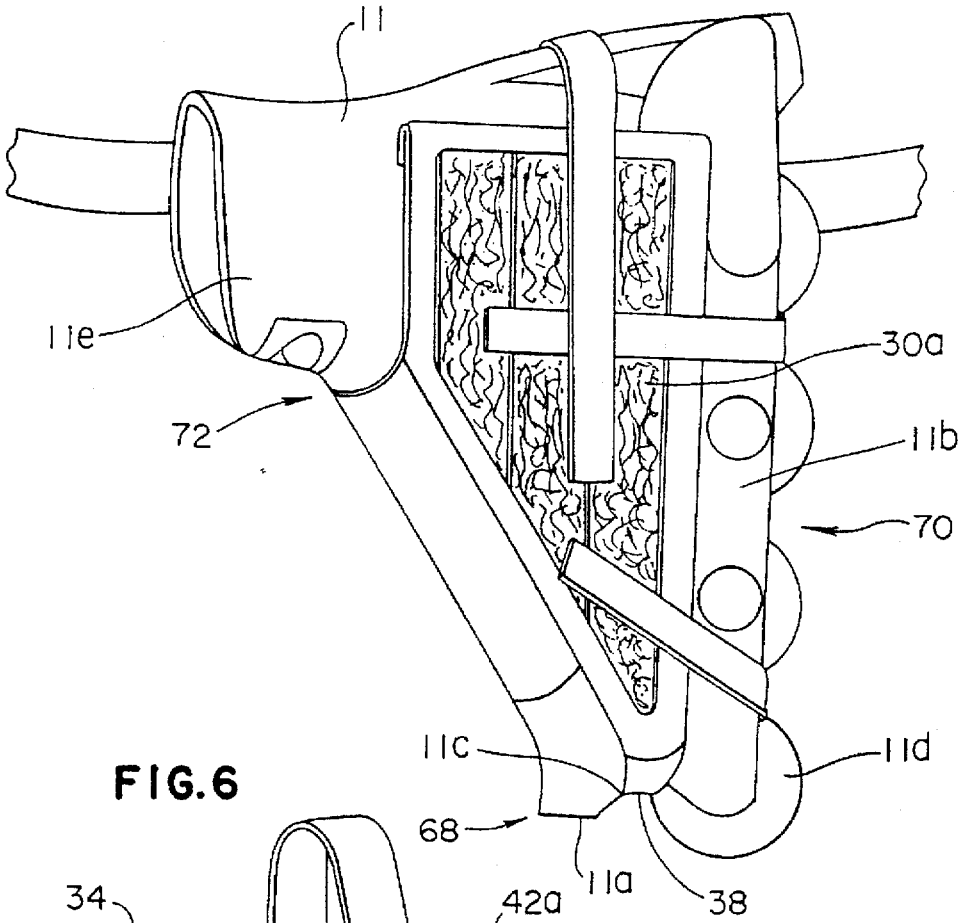
FIG. 5 is a perspective view of a receptacle of the skate carrier of the present invention.

Accordingly as shown in FIG. 5, when a roller skate 11 with a toe 11*a* and wheel set 11*b* is inserted into the receptacle 30*a*, the bearing member 38 engages the space 11*c* between the toe 11*a* and the wheel set 11*b*. The toe of the skate 11 protrudes through the toe opening 68, and the wheel set 11*b* extends through the wheel set opening 70. The weight distribution in most skates 11 of the in-line variety provides a weight balance on or near the front wheel 11*d* of the wheel set 11*b*. Therefore, when the thong of the bearing member 38 engages the space 11*c* between the toe 11*a* and the wheel set 11*b*, the skate 11 is maintained in the receptacle 30*a* in a toe-down configuration.

An ankle support opening 72 is also provided in the receptacle 30*a*. The ankle support 72 opening is defined by the first rear edge 42*d*, the top edge 60 of the positioning member 40 and the second rear edge 44*d*. The ankle support 11*e* of the skate 11 extends through the ankle support opening 72 when the skate 11 is placed in the receptacle 30*a*.

Figure 8:
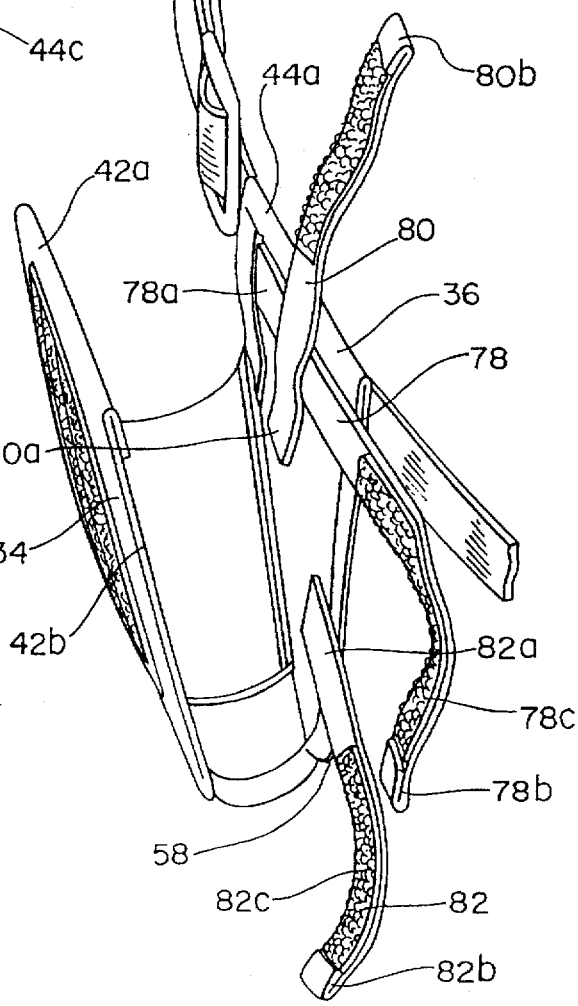
FIG. 8 is a frontal perspective view of the skate receptacle of the present invention fully opened.

FIG. 8 shows three bands, a horizontal band 78, a vertical band 80 and a diagonal band 82, all stitched at a first end 78*a*, 80*a* and 82*a* of the band to the interior side of the first wall 32. The bands 78, 80 and 82 all have second ends 78*b*, 80*b* and 82*b* of each band. Strips of VELCRO® hooks 78*c*, 80*c* and 82*c* are stitched to an interior of said bands 78, 80 and 82 and extend from the second end 78*b*, 80*b*, and 82*b* to a length short of the first end 78*a*, 80*a* and 82*a* of the bands. By using the VELCRO® engagement, any desired portion of the bands along the strip of VELCRO® hooks 78*c*, 80*c* and 82*c* can be attached to the strips 43 of VELCRO® loops on the first wall 32. Therefore, the length of each band 78, 80 and 82 between the first end 78*a*, 80*a* and 82*a*, respectively, and the desired portion engaged to the first wall 32 can be adjusted to accommodate skates 11 of varying lengths and thicknesses.

The horizontal band 78 is stitched to the interior of the second wall 34 just below the first top edge 44*a*, so the strip of VELCRO® hooks 78*c* on the band may be wrapped around the skate 11 to engage the strips of VELCRO® loops 43 on the exterior side of the second wall 34 shown in FIG. 6. The horizontal band is long enough to double back, so the VELCRO® hooks on the strip 78*c* near the second end 78*b* can engage the strip of VELCRO® loops 50 stitched on the exterior side of the second wall 34. The vertical band 80 is stitched to the interior of the second wall 34 inside the first front edge 44*b*, so that it may be wrapped around and the strip of VELCRO® hooks 80*c* can engage the strips of VELCRO® loops 43 on the exterior side of the first wall 32. The diagonal band 82 is stitched to the interior of the second wall 34 above the second bottom corner 58, so that it may also be wrapped around and the strip of VELCRO® hooks 58*c* can engage the strips of VELCRO® loops 43 on the exterior side of the first wall 32. Although not shown, it may be desirable to stitch VELCRO® loops to the exterior of bands 78, 80 and 82 to facilitate engagement of overlapping bands.

The use of the bands 78, 80 and 82 to position the spacing between the first wall 32 and the second wall 34 enables the receptacle 30*a* to support a skate 11 of any size. Additionally, the bands 78, 80 and 82 can be used to reduce the spacing between the first wall 32 and the second wall 34 to retain a street shoe in the receptacle 30 as shown in FIG. 8.

Figure 9:
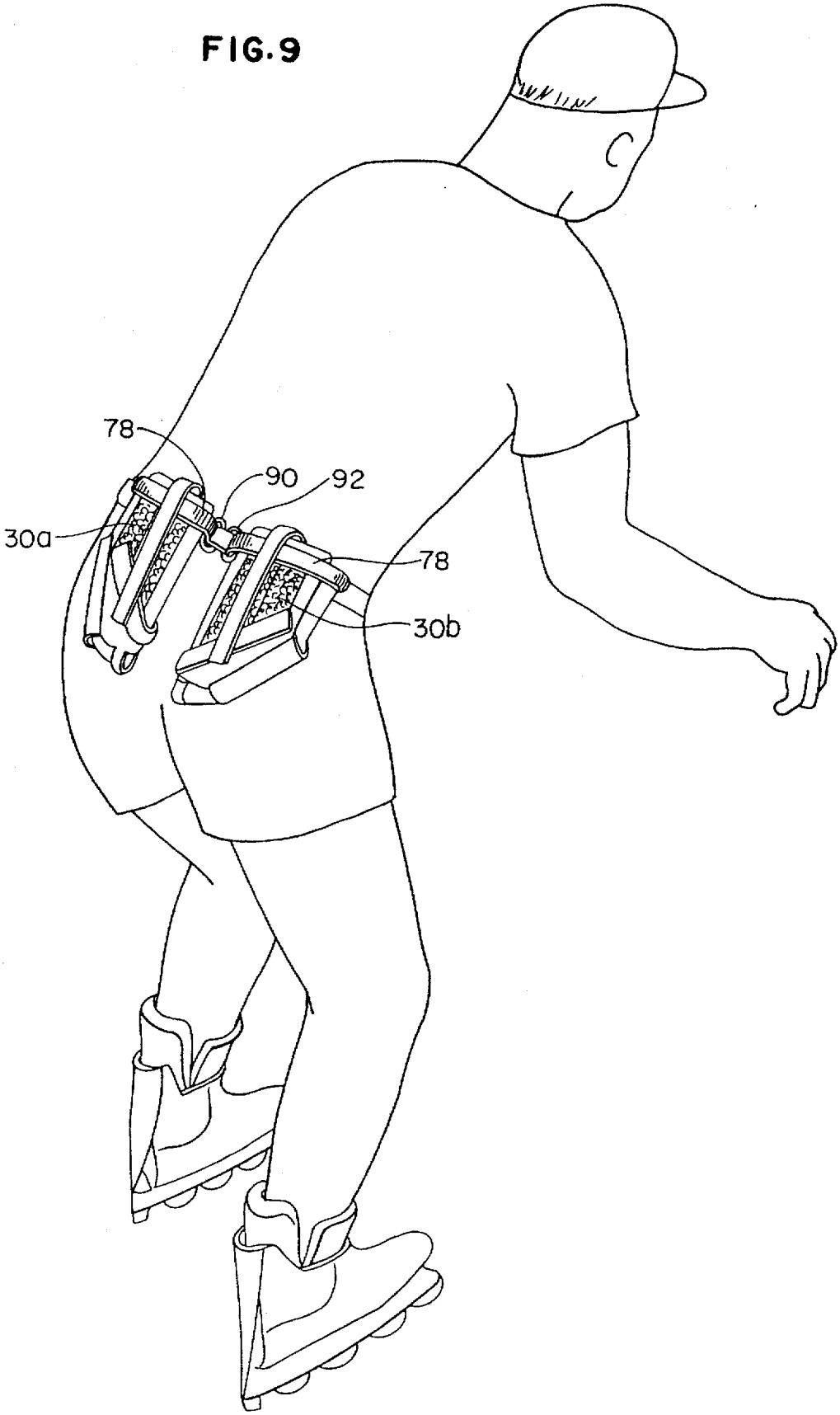
FIG. 9 is a perspective view of a user skating with the skate carrier of the present invention carrying street shoes.

The user of the skate carrier 10 described will appreciate that the receptacles 30*a*, 30*b* are suspended from the strap 12 by the loops 48 attached to each receptacle 30*a*, 30*b*. Therefore, when a skate 11 is placed within each receptacle 30*a*, 30*b* and the strap 12 fastened around the waist, the user can adjust the receptacles 30*a*, 30*b* to suspend from any point along the strap 12. One might choose to wear the skate receptacles at the sides of the waist on the hips or at the center of the lower back. The latter position may be preferred when the user is skating and carrying his street shoes in the skate carrier 10, as shown in FIG. 9. The former position is preferred when carrying the skates around the waist. Hence, the street shoes do not interfere with the user's motion or balance. These and other arrangements are made possible by the invention described.

A first ring 90 and a second ring 92 are stationed at a midpoint between the first effective end and the second effective end on the strap 12. The first ring 90 can receive the horizontal band 78 of the first receptacle 30*a* and the second ring 92 can receive the horizontal band 78 of the second receptacle 30*b*. Once the bands 78 are looped through the rings 90, 92, they can be doubled back and strips 78*c* engaged to the strips of VELCRO® loops 43 on the first wall 32 of the respective receptacle 30*a*, 30*b* to maintain the receptacle 30*a*, 30*b* within a desired distance from the midpoint of the strap 12. The horizontal band 78 on the first receptacle 30*a* and the horizontal band 78 on the second receptacle 30*b* must be sufficiently long to enable looping through the respective ring, 90, 92, and doubling back to be engaged to the exterior of the first wall 32 of the respective receptacle 30*a*, 30*b*.

Alternatively, a first front ring (not shown) may be fastened toward the first effective end 24 and a second front ring (not shown) may be fastened toward the second effective end 28 of the strap 12. A first additional band (not shown) attached near the front edge to the first receptacle 30*a*, and a second additional band (not shown) attached near the front edge of the second receptacle 30*b* can be looped through the respective ring and doubled back and attached to the respective receptacle 30*a*, 30*b*. This alternative fastening arrangement can be used to secure the front of the receptacles 30*a*, 30*b* relative to the respective front ring in addition to or as an alternative to anchoring the receptacles 30*a*, 30*b* at the rings 90, 92, respectively, at the midpoint of the strap 12.

It will be appreciated that this detailed description relates to the preferred embodiment byway of example only. Many variations on the invention will be obvious to those knowledgeable in the field, and such obvious variations are within the scope of the invention as described and claimed, whether or not expressly described.

I claim:

1. A shoe-carrying device in combination with a shoe comprising:

(a) a selected shoe from a range of different sizes; and (b) a shoe-carrying device including an elongate strap with a first end and a second end, said first end having a coupling means for securement of said first end to said second end, at least one receptacle having a bearing member in engagement with said shoe at a toe of said shoe for supporting said shoe with a bottom of said shoe being substantially vertically disposed with respect to the ground in said receptacle, a first wall and a second wall for cooperatively maintaining said shoe in engagement with said bearing member, and means for adjustably coupling said first wall to said second wall to secure said shoe in said receptacle, and a retainer on said receptacle for suspending said receptacle on said strap.

2. The device of claim 1 wherein said shoe is a skate and said bearing member is a thong with a first end attached to said first wall and a second end attached to said second wall, said thong engages said skate between wheels of said skate and the toe of said skate.

3. The device of claim 2 wherein said skate is a roller skate and said first wall has a first front edge and said second wall has a second front edge, said first front edge and said second front edge define an opening through which wheels of said skate extend.

4. The device of claim 2 wherein said first wall has a first rear edge and said second wall has a second rear edge, said first rear edge and said second rear edge define an opening for accommodating an ankle support of said skate.

5. The device of claim 2 including a stationary loop on said strap through which a band can be threaded and a desired portion of said band can be removably attached to said receptacle to prevent said receptacle from sliding along said strap.

6. The device of claim 2 wherein said first wall is defined by a first top edge which is adjacent to a first rear edge which is adjacent to a first bottom edge which is adjacent to a first front edge, said first front edge being longer than said first rear edge and said first rear edge and said first bottom edge intersect at a first bottom corner; said second wall is defined by a second top edge which is adjacent to a second rear edge which is adjacent to a second bottom edge which is adjacent to a second front edge, and said second rear edge and said second bottom edge intersecting at a second bottom corner.

7. The device of claim 6 wherein said first end of said thong attaches to said first bottom corner and said second end of said thong attaches to a second bottom corner.

8. The device of claim 7 having a positioning member for additionally maintaining said skate in said receptacle with a first side attached to said first bottom edge and a second side attached to said second bottom edge.

9. The device of claim 8 wherein said positioning member is contiguous with said first bottom edge and said second bottom edge; said positioning member having a lower edge disposed short of said first bottom corner and said second bottom corner thereby providing an opening through which a toe of said skate may protrude, said opening defined by said thong, said first bottom edge, said lower edge and said second bottom edge.

10. The device of claim 1 wherein said means for adjustably coupling said first wall to said second wall includes: a band with a first end and a second end, said first end of said band being attached to said first wall; and means for removably attaching a desired portion of said band, between said first end and said second end of said band, to said second wall thereby defining a receiving space between said first wall, said second wall and said band of sufficient capacity to accommodate said selected shoe.

11. The device of claim 10 wherein said space between said first wall, said second wall and said band can he readjusted to carry a different shoe from a range of different sizes.

12. The device of claim 10 wherein said band is a horizontal band adapted to removably attach to said second wall adjacent said second top edge.

13. The device of claim 12 wherein the means for adjustably coupling said first wall to said second wall further includes a vertical band having a first end and a second end, said first end being attached to said first wall, and means for removably attaching a desired portion of said vertical band between said first end and said second end to said second wall, said vertical band thereby cooperating with said horizontal band to define the desired capacity between said first wall and said second wall to secure said selected shoe.

14. The device of claim 13 wherein the means for adjustably coupling said first wall to said second wall further includes a diagonal band having a first end and a second end, said first end being attached to said first wall and means for removably attaching a desired portion of said diagonal band between said first end and said second end to said second wall, said diagonal band thereby cooperating with said horizontal band and said vertical band to define the desired capacity between said first wall and said second wall to secure said selected shoe.

15. The device of claim 1 wherein the retainer on said receptacle slidably engages said elongate strap so a user can position said receptacle at a desired point on said strap.

16. The device of claim 1 including a second receptacle with the same structure and function as said receptacle.

17. The device of claim 1 wherein said first end of said strap further includes a first supplemental strap having a proximal end and a distal end, said distal end of said first supplemental strap connected to said strap distant from said first end; said second end of said strap includes a second supplemental strap having a proximal end and a distal end, said distal end of said second supplemental strap connected to said strap distant from said second end; said proximal end of said first supplemental strap and said proximal end of said second supplemental strap being removably attachable by hook and loop fastening means to supplement the securement of said first end to said second end.

18. The device of claim 1 wherein the strap has an adjustable length.

19. The device of claim 1 wherein said shoe is a skate.

* * * * *